United States Patent [19]

Toth

[11] Patent Number: 4,493,236

[45] Date of Patent: Jan. 15, 1985

[54] MAILING MACHINE TAPE KNIFE

[75] Inventor: William D. Toth, Milford, Conn.

[73] Assignee: Pitney Bowes Inc., Stamford, Conn.

[21] Appl. No.: 516,837

[22] Filed: Jul. 25, 1983

[51] Int. Cl.[3] ..... B26D 1/14

[52] U.S. Cl. ..... 83/440.1; 83/586; 83/611; 83/673

[58] Field of Search ..... 83/610–612, 83/440, 348, 440.1, 441, 203–205, 349, 673, 586

[56] References Cited

U.S. PATENT DOCUMENTS

| | | | |
|---|---|---|---|
| 1,849,443 | 3/1932 | Wheeler, Jr. et al. | 83/611 |
| 3,568,556 | 3/1971 | Gesell et al. | 83/611 |
| 3,651,727 | 3/1972 | Suzuki et al. | 83/205 |
| 3,855,891 | 12/1974 | Young | 83/611 |
| 4,114,491 | 9/1978 | Hashimoto et al. | 83/349 |

*Primary Examiner*—Frank T. Yost
*Assistant Examiner*—Hien H. Phan
*Attorney, Agent, or Firm*—Lawrence E. Sklar; William D. Soltow, Jr.; Albert W. Scribner

[57] ABSTRACT

A device for cutting roll tape, including a frame, a serrated rotary blade pivotably mounted in the frame, the rotary blade having a plurality of cutting teeth formed by grooves running perpendicular to the axis of the rotary blade and a flat surface cut across the rotary blade, and at least one continuous groove at each end of the serrated rotary blade adjacent the plurality of cutting teeth, a serrated stationary blade pivotably mounted on the frame, the stationary blade having a plurality of cutting teeth, the stationary blade cutting teeth being meshable with the cutting teeth on the rotary blade, the stationary blade also having at least one long tooth at each end of the stationary blade adjacent the plurality of short cutting teeth, the long teeth reaching the tangency of the continuous grooves and riding therein, and wherein the cutting teeth are sufficiently shortened to provide the desired clearance at the cutting interface, and a biasing element for biasing the long teeth of the stationary blade into the continuous grooves of the rotary blade.

5 Claims, 6 Drawing Figures

MAILING MACHINE TAPE KNIFE

BACKGROUND OF THE INVENTION

The instant invention relates to mailing machines and in particular to a serrated rotary knife in a mailing machine used for cutting gummed tape therein.

Many types of mailing matter which require postage are of such a nature that they cannot be passed through a mailing machine in the manner of an envelope or they cannot be printed on by the postage meter associated with the mailing machine. This problem is overcome in mailing machines by providing the mailing machine with a roll of gummed tape which can receive the postage indicia printed by the postage meter. The printed tape is thereafter affixed to the mailing matter.

Obviously the rolled tape must be severed prior to affixing the tape to the mailing matter. The tape knives used on mailing machines to sever the tape are serrated and have proven to be difficult to adjust and have required the factory assembler or a service man to develop a feel for the proper adjustment of the knife. This process is time consuming since it requires repeated loosening and retightening of the adjusting screws, and there is always the risk of damage to the unhardened rotary blade resulting from an improper adjustment.

The instant invention therefore provides a mailing machine tape cutting device which needs no adjustment at assembly or thereafter due to a unique technique of pivoting and spring loading the stationary blade into its proper relationship with the rotary blade. The tape cutting device of the instant invention also provides a more rigid stationary blade configuration.

SUMMARY OF INVENTION

Accordingly, the instant invention provides a device for cutting roll tape. The device includes a frame, a serrated rotary blade pivotably mounted in said frame, said rotary blade having a plurality of cutting teeth formed by grooves running perpendicular to the axis of the rotary blade and a flat surface cut across the rotary blade, and at least one continuous groove at each end of said serrated rotary blade adjacent said plurality of cutting teeth, a serrated stationary blade pivotably mounted on said frame, said stationary blade having a plurality of cutting teeth, said stationary blade cutting teeth being meshable with said cutting teeth on said rotary blade, said stationary blade also having at least one long tooth at each end of said stationary blade adjacent said plurality of short cutting teeth, said long teeth reaching the tangency of said continuous grooves and riding therein, and wherein said cutting teeth are sufficiently shortened to provide the desired clearance at the cutting interface; and means for biasing said long teeth of said stationary blade into said continuous grooves of said rotary blade.

DETAILED DESCRIPTION

Figure 1:
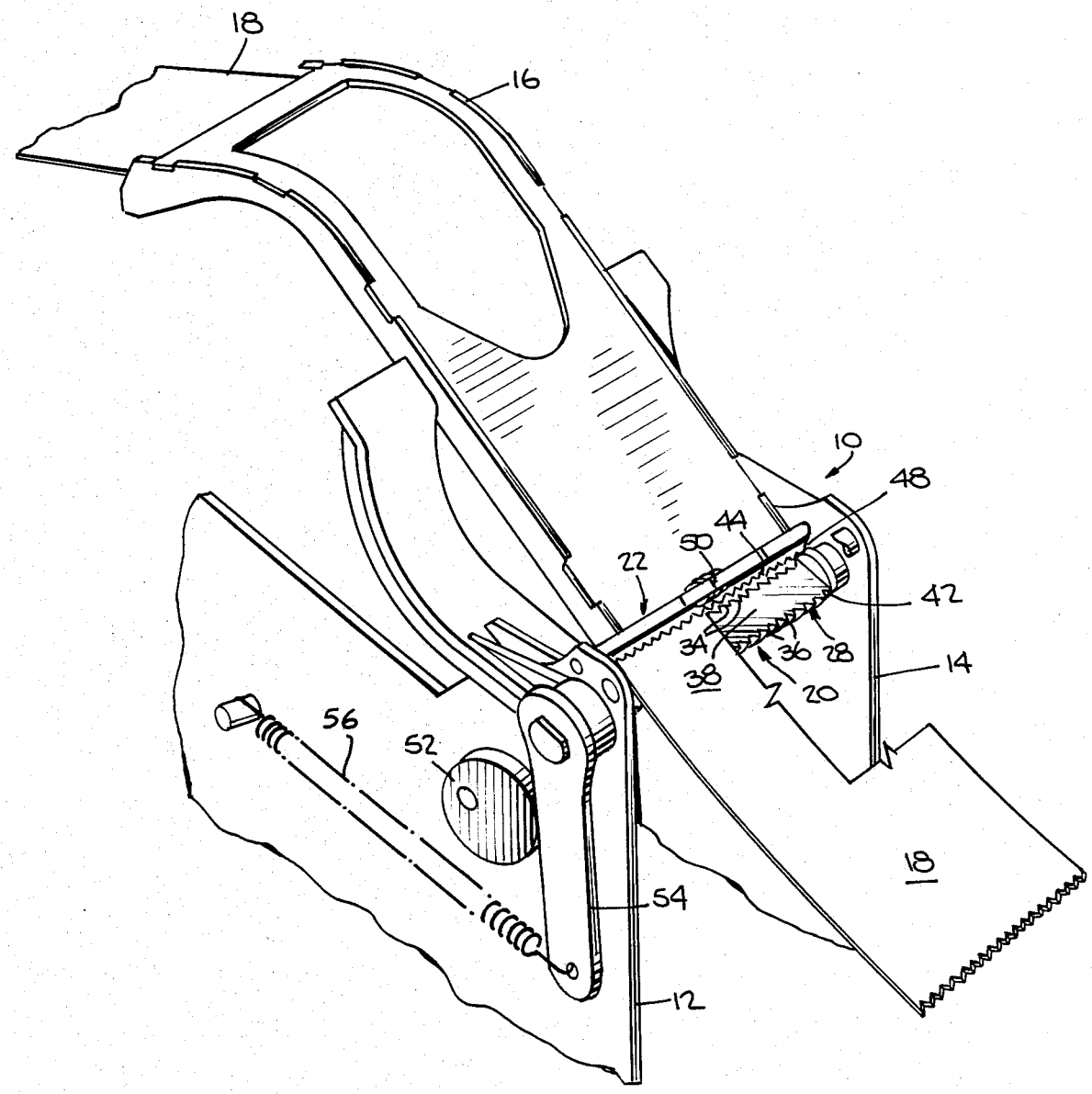
FIG. 1 is a perspective view of a roll tape rotary knife according to the instant invention.
Figure 2:
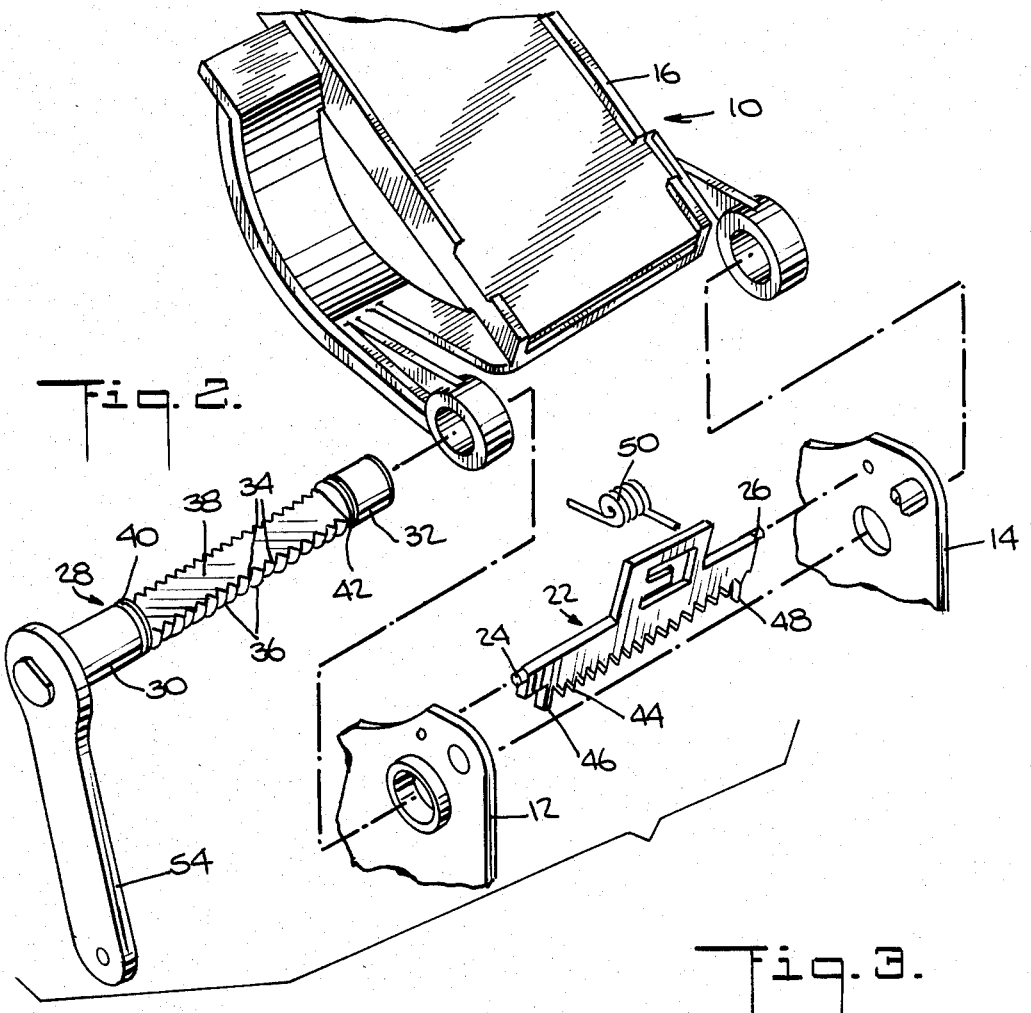
FIG. 2 is an exploded, perspective view of the roll tape rotary knife seen in FIG. 1.

In describing the preferred embodiment of the instant invention, reference is made to the drawings, wherein there is seen in FIGS. 1 and 2 a roll tape cutting module generally designated 10 having a pair of sidewalls 12 and 14. A tape guide 16 for guiding the roll tape 18 toward the rotary knife assembly generally designated 20 is mounted in the sidewalls 12 and 14 as explained in more detail hereinafter.

Figure 4:
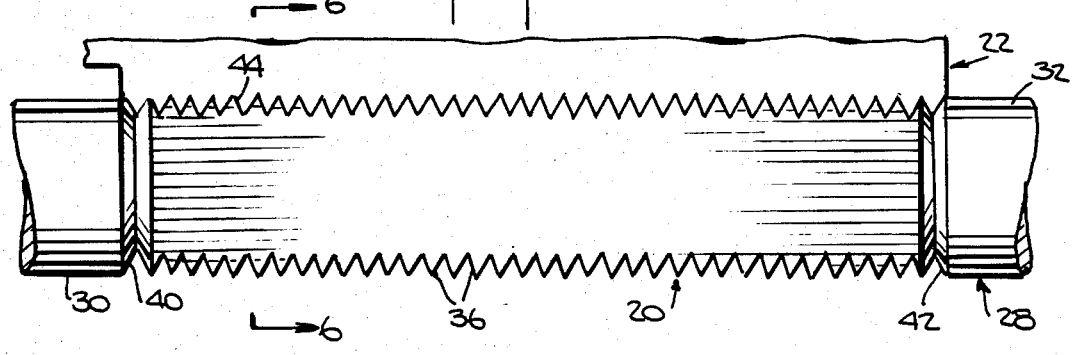
FIG. 4 is the same as FIG. 3 except the blades of the rotary knife are seen in their respective positions after the cutting of the tape.
Figure 5:
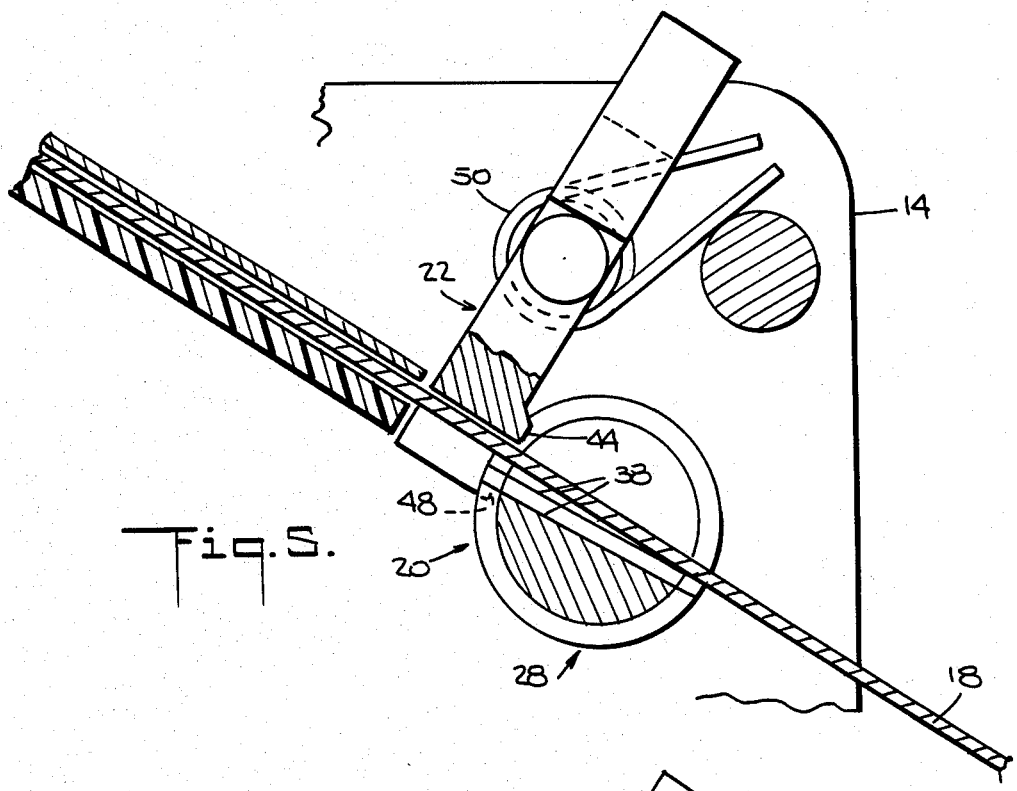
FIG. 5 is a sectional view taken on the vertical plane indicated by the line 5—5 in FIG. 3.
Figure 6:
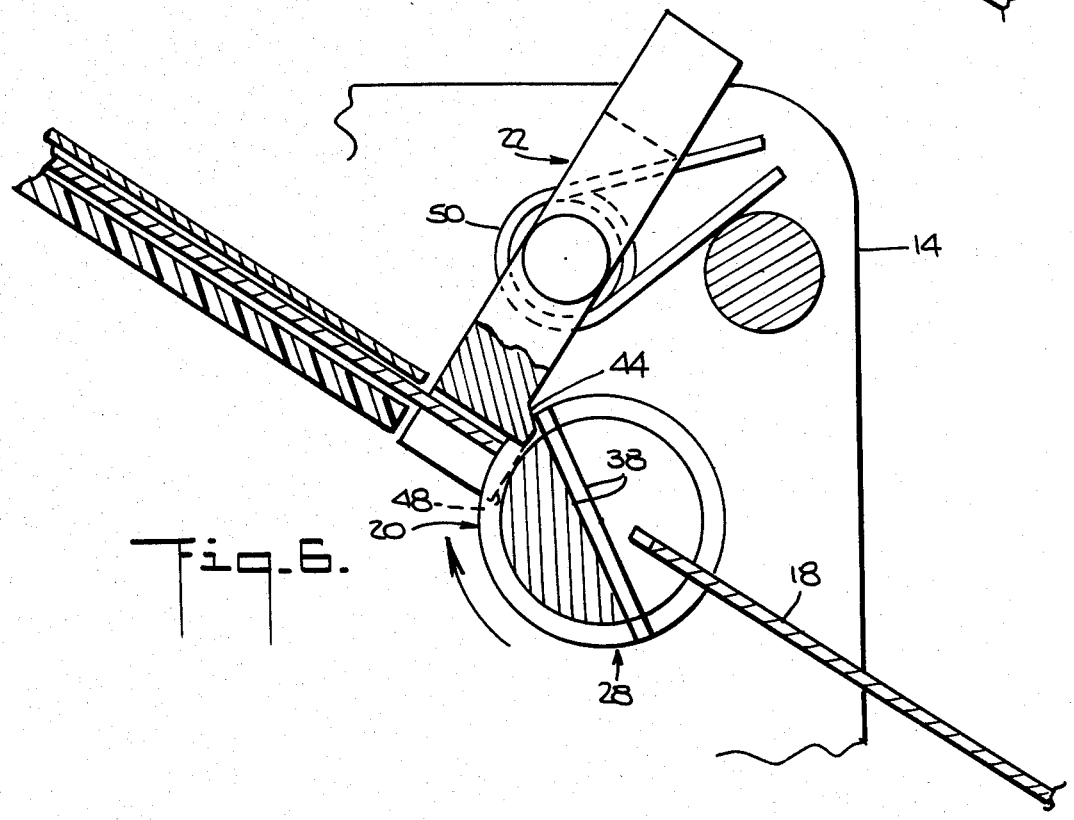
FIG. 6 is a sectional view taken on the vertical plane indicated by the line 6—6 in FIG. 4.

The rotary knife assembly consists of a stationary, serrated blade 22 having a pair of shanks 24 and 26 (see FIG. 2) pivotably mounted in the sidewalls 12 and 14 respectively, and a serrated, rotary blade 28 having a pair of shanks 30 and 32 (see FIGS. 2–4) rotatably mounted in the sidewalls 12 and 14 respectively. As best seen in FIG. 2, the rotary blade 28 includes a plurality of cutting teeth 34 formed by an equal number of grooves 36 running perpendicular to the axis of the rotary blade 28 and a flat surface 38 cut across the blade 28 on an angle as best seen in FIGS. 5 and 6. A pair of continuous grooves 40 and 42 are situated at each end of the rotary blade 28 adjacent the plurality of cutting teeth 34. The stationary blade 22 includes a plurality of cutting teeth 44 which mesh with the cutting teeth 34 of the rotary blade 28. A pair of long teeth 46 and 48 (see FIG. 2) are situated at each end of the stationary blade 22 adjacent the cutting teeth 44. The continuous grooves 40 and 42 of the rotary blade 28 ride on the long teeth 46 and 48 respectively of the stationary blade 22. The stationary blade 22 pivots about its shanks 24 and 26 and its long teeth 46 and 48 are biased into riding engagement with the grooves 40 and 42 by means of a torsion spring 50 (see FIGS. 2, 5 and 6).

The clearance between the cutting teeth 34 of the rotary blade 28 and the cutting teeth 44 of the stationary blade 22 is maintained constant by virtue of the riding contact between the long teeth 46 and 48 of the stationary blade 22 and the continuous grooves 40 and 42 respectively of the rotary blade 28, thereby eliminating any and all need for adjustment of the rotary knife assembly 20. As best seen in FIGS. 5 and 6, the long teeth 46 and 48 of the stationary blade 22 reach the tangency of the continuous grooves 40 and 42 respectively of the rotary blade 28, and the cutting teeth 44 of the stationary blade 22 are sufficiently shortened to provide the desired clearance at the cutting interface (see FIG. 3).

Figure 3:
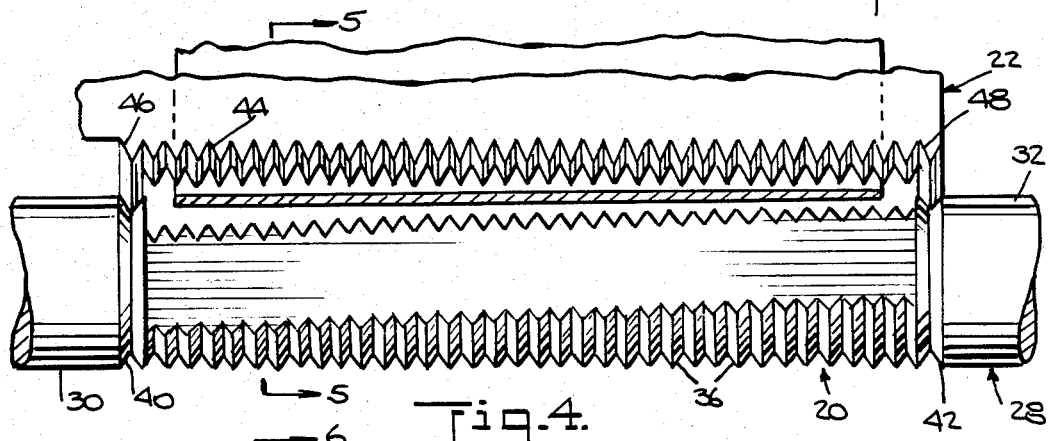
FIG. 3 is an enlarged, axial sectional view of the rotary and stationary blades of the rotary knife showing their respective positions prior to cutting of the tape.

The position of the rotary blade 28 prior to cutting is seen in FIGS. 1, 3 and 5 and is maintained by a cam 52 which governs the position of a cam following arm 54 of the rotary blade 28 (see FIG. 1). A spring 56 biases the following arm 54 against the cam 52, and when a cut is desired, the cam 52 rotates to a position which permits the spring 56 to rotate the following arm 54 in a clockwise direction, thereby rotating the rotary blade 28 and effecting a cut of the tape 18 beginning at the end of the tape 18 adjacent the long tooth 48 and ending at the end of the tape 18 adjacent the long tooth 46.

While there have been shown and described and pointed out the fundamental novel features of the invention as applied to a preferred embodiment, it will be understood that various omissions and substitutions and changes in the form and details of the device illustrated and in its operation may be made by those skilled in the art without departing from the spirit of the invention.

What is claimed is:

1. A device for cutting roll tape, including:

a frame;

a serrated rotary blade pivotably mounted in said frame, said rotary blade having a plurality of cutting teeth formed by grooves running perpendicular to the axis of the rotary blade and a flat surface cut across said rotary blade, said rotary blade having at least one continuous groove at each end of said serrated rotary blade adjacent said plurality of cutting teeth;

a serrated stationary blade pivotably mounted on said frame, said stationary blade having a plurality of cutting teeth, said stationary blade cutting teeth being meshable with said cutting teeth on said rotary blade, said stationary blade also having at least one long tooth at each end of said stationary blade adjacent said plurality of short cutting teeth, said long teeth reaching the tangency of said continuous grooves and riding therein, and wherein said cutting teeth are sufficiently shortened to provide the desired clearance at the cutting interface; and means for biasing said long teeth of said stationary blade into said continuous grooves of said rotary blade.

2. The device of claim 1, wherein the flat surface of the rotary blade is inclined at a slight angle whereby cutting of the roll tape is begun at one side of the tape and concluded at the other side of the tape.

3. The device of claim 2, additionally including a tape guide for guiding the roll tape toward the rotary and stationary blades.

4. The device of claim 2, wherein the biasing means comprises a torsion spring.

5. The device of claim 2, additionally comprising a cam, a cam following arm fixedly secured to said rotary blade, and a spring for biasing said following arm against said cam, and wherein when a cut is desired, the cam rotates to a position permitting the spring to rotate the following arm, thereby rotating the rotary blade and effecting a cut of the tape.

* * * * *